US005347497A

United States Patent [19]

Allen

[11] Patent Number: 5,347,497

[45] Date of Patent: Sep. 13, 1994

[54] TIDE INDICATOR SYSTEM

[76] Inventor: Stephen J. Allen, 119 Hemlock Rd., Sudbury, Mass. 01776

[21] Appl. No.: 936,037

[22] Filed: Aug. 25, 1992

[51] Int. Cl.[5] ..... G04B 19/26

[52] U.S. Cl. ..... 368/19

[58] Field of Search ..... 368/15-19

[56] References Cited

U.S. PATENT DOCUMENTS 4,403,869 9/1983 Crutcher ..... 368/10

4,576,273 3/1986 Milnes ..... 194/209

4,993,002 2/1991 Kerr ..... 368/19

*Primary Examiner*—Bernard Roskoski

*Attorney, Agent, or Firm*—Joseph S. Iandiorio

[57] ABSTRACT

A graphic tide indicator system in which time intervals between a plurality of corrective tides are stored, the temporal position in the current time interval is determined, and a visual display is employed to display the relative water depth.

21 Claims, 5 Drawing Sheets

Example:

Depth of Previous Tide: 5
Depth of Next Tide: 26
Duration of Tide: 373 minutes
Current Temporal Position in Tide: 250 minutes
Current Depth: 22 from Curve

120

| Interval Number | Scale Display | Scene Description | Display Portion Lit (From Fig. 6) | Scene Number |
|---|---|---|---|---|
| 0 | High Tide | 100% of water display | 71 | 10 |
| 1 | 15 minutes from | | | |
| 2 | 30 minutes from | | | |
| 3 | 45 minutes from | | | |
| 4 | 1 Hour from | 90% of water display | 70 | 9 |
| 5 | 1:15 from High Tide | | | |
| 6 | 1:30 from High Tide | 80% of water display | 69 | 8 |
| 7 | 1:45 from High Tide | | | |
| 8 | 2:00 from High Tide | 70% of water display + First set of puddles | 68 + 80 | 18 |
| 9 | 2:15 from High Tide | | | |
| 10 | 2:30 from High Tide | 60% of water display + Second set of puddles | 67 + 81 | 17 |
| 11 | 2:45 from High Tide | | | |
| 12 | 3:00 from High Tide | 50% of water + Third puddle | 66 + 82 | 16 |
| 13 | 3:15 from High Tide | 40% of water display + Fourth puddle | 65 + 83 | 15 |
| 14 | 3:30 from High Tide | | | |
| 15 | 3:45 from High Tide | 30% of water display + Fifth puddle | 64 + 84 | 14 |
| 16 | 4:00 from High Tide | | | |
| 17 | 4:15 from High Tide | 20% of water display + Sixth puddle | 63 + 85 | 13 |
| 18 | 4:30 from High Tide | | | |
| 19 | 4:45 from High Tide | 10% of water display + Seventh set of pubbles | 62 + 86 | 12 |
| 20 | 5:00 from High Tide | | | |
| 21 | 5:15 from High Tide | 0% of water display + One of the Seventh set of puddles | 61 + 86 | 11 |
| 22 | 5:30 from High Tide | | | |
| 23 | 5:45 from High Tide | | | |
| 24 | 6:00 from High Tide | | | |
| 25 | Low Tide | 0% of water display without puddles | 61 | 0 |
| 26 | 6:00 to High Tide | | | |
| 27 | 5:45 to High Tide | | | |
| 28 | 5:30 to High Tide | | | |
| 29 | 5:15 to High Tide | | | |
| 30 | 5:00 to High Tide | 10% of water display | 62 | 1 |
| 31 | 4:45 to High Tide | | | |
| 32 | 4:30 to High Tide | 20% of water display | 63 | 2 |
| 33 | 4:15 to High Tide | | | |
| 34 | 4:00 to High Tide | 30% of water display | 64 | 3 |
| 35 | 3:45 to High Tide | | | |
| 36 | 3:30 to High Tide | 40% of water display | 65 | 4 |
| 37 | 3:15 to High Tide | | | |
| 38 | 3:00 to High Tide | 50% of water display | 66 | 5 |
| 39 | 2:45 to High Tide | 60% of water display | 67 | 6 |
| 40 | 2:30 to High Tide | | | |
| 41 | 2:15 to High Tide | 70% of water display | 68 | 7 |
| 42 | 2:00 to High Tide | | | |
| 43 | 1:45 to High Tide | 80% of water display | 69 | 8 |
| 44 | 1:30 to High Tide | | | |
| 45 | 1:15 to High Tide | 90% of water display | 70 | 9 |
| 46 | 1 hour to High Tide | | | |
| 47 | 45 minutes to | 100% of water display | 71 | 10 |
| 48 | 30 minutes to | | | |
| 49 | 15 minutes to | | | |

Fig. 7

TIDE INDICATOR SYSTEM

FIELD OF INVENTION

This invention relates to a tide indicator system that has stored in memory the time and optionally the height differences between tidal events for accurate visual indication of the current tidal condition.

BACKGROUND OF INVENTION

There are many varieties of tide clock devices on the market and patented. These devices, whether mechanical or electrical, use a predetermined time period, typically twelve hours and twenty-five minutes, representing an average tidal cycle. The devices are then set by the user to the proper point in the current tidal cycle using local information or National Oceanic and Atmospheric Administration (NOAA) tide chart information. Examples of such devices may be found in U.S. Pat. Nos. 3,703,804, 4,035,167, 4,412,749, and 4,849,949.

The display incorporated in these devices takes many forms. Many display the time to or from high and low tide in hours and minutes. Others have a more graphic display that is indicative of the relative height of the water as opposed to the time to the next tidal event. Many of these displays use motor-driven discs that move by a viewing window to create a display that changes with time. Other devices use electronic displays such as bar graph displays to indicate the relative water height.

In reality, the tidal interval, or time between consecutive tides, differs between every tidal cycle. The tidal cycle difference causes such devices that use a constant interval to predict the next tidal occurrence to be in error by as much as plus or minus one hour. In addition, these devices can be set at a time when the actual tidal interval is in error from the average tidal interval, thereby causing additional error.

The height of each tidal occurrence is different. Devices that use a constant mechanism to display the height of the next tidal occurrence can be in error by as much as 50% of the relative height. In addition, these devices can be set at a time when the actual tidal height is in error from the average tidal height, thereby causing additional error in both the time of the next tidal occurrence and the relative height of the water.

SUMMARY OF INVENTION

It is therefore an object of this invention to provide a tide indicating system that accurately indicates the state of the tide.

It is a further object of this invention to provide such a system that is accurate to within one minute.

It is a further object of this invention to provide such a system that has a graphic display that indicates the relative height of the water.

This invention results from the realization that a truly unique tide indicating system may be accomplished by storing in memory consecutive tidal durations and optionally tide heights for a number of geographical locations, and allowing the user to select a location for display, in which the system determines the current temporal position in the current tidal duration, and in response sequentially lights a display, which may include a number of ocean scenes, indicative of the relative water height.

This invention may be accomplished in a graphic tide indicator system that includes means for storing the time intervals between a plurality of consecutive high tides, means for determining the temporal position in the current time interval, and a visual display means such as an LCD, bar graph, or CRT, which in one embodiment may have a plurality of sequential scenes representing variations of the water level between tidal extremes, for displaying, in response to the temporal position, the relative water depth, or the scene corresponding to the current time. The temporal position may be determined in relation to a number of consecutive time periods for each time interval. Preferably, most of the time periods are of predetermined length and one or more are of variable length to account for variations in the length of the time intervals so that the system can accurately display the actual tidal information of the chosen geographical location. In one embodiment for use on the east coast, there are fifty time periods, forty-seven of which are fixed at fifteen minutes, one of which is adjustable between zero and thirty minutes, and two of which have fixed fifteen minute intervals but are selectively used to account for tidal variations between eleven hours and forty-six minutes and twelve hours and forty-five minutes.

In a preferred embodiment, the visual display includes nineteen different sequential scenes. Preferably, there are a plurality of different scenes between high tide and low tide and also a plurality of different scenes between low tide and high tide. In one embodiment, one or more of the scenes are repeated from high tide to low tide and low tide to high tide. In one such embodiment, three scenes are repeated.

Preferably, the system has in memory durations of tidal events for a number of years for a number of different coastal locations, and the system is enabled to allow user selection of a coastal location for display. For another location, the system may be enabled to allow the user to add a time offset so that the system accurately tracks the tides at such location. Further, the system allows the user to input the date and time of the next high tide for the chosen location as well as the current time so that the system may determine the correct point of display for the current tidal interval to properly complete the display of that interval so that the system is accurate to within plus or minus one minute.

In an alternative embodiment, the graphic tidal indicator system includes means for storing the time interval between a plurality of consecutive tidal events for a plurality of different coastal locations, means for providing a choice between the different coastal locations, means for determining the current date and time, and means for displaying the current tidal state for the chosen coastal location. In that case, the display may include means for depicting a scene representative of the current tidal position.

The system may calculate water depth based on stored values for each tidal event in memory. That depth information may then be displayed. This is accomplished in one embodiment by storing the time intervals between and heights of a number of consecutive tides, determining the current temporal position in the current interval, calculating, in response to the temporal position and the height information, the approximate current water depth, and displaying such depth, for example in relation to maximum and minimum depths, by using a bar graph display.

DISCLOSURE OF PREFERRED EMBODIMENTS

Other objects, features and advantages will occur to those skilled in the art from the following description of a preferred embodiment and the accompanying drawings, in which:

FIG. 7 is a chart of the sequential divisions of the tidal durations accomplished by the system of this invention and the corresponding scale and scene displays for the display of FIG. 6.

Figure 1:
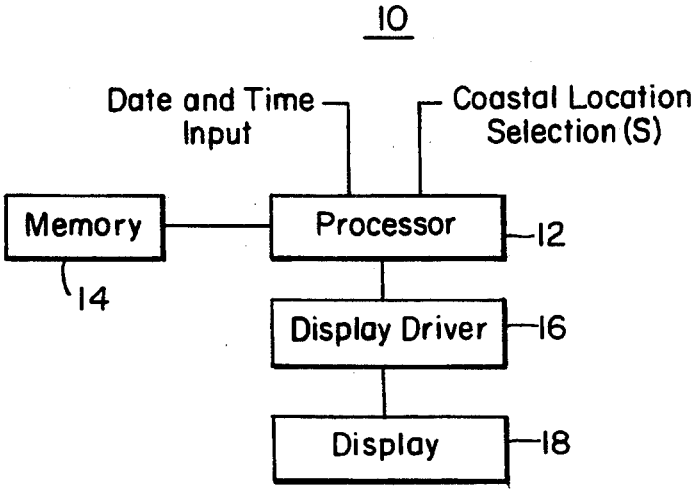
FIG. 1 is a block diagram of the tide indicating system of this invention.

There is shown in FIG. 1 tide indicating/display system 10 according to this invention. System 10 includes processor 12 that is responsive to memory 14. Within memory 14 is kept information from which may be derived the duration in hours and minutes between consecutive tidal events taken from the information developed by the National Oceanic and Atmospheric Administration (NOAA). For embodiments which display water depth, the memory also includes water depth for each high and low tide. Memory 14 in one embodiment has tidal durations and depths for ten years for a number of coastal locations. Processor 12 is enabled to accept a user selection of a coastal location for which the tidal information is to be displayed, and, if necessary, a high and low tide offset from that location for the user's exact location. Processor 12 may also accept the input of the current year, month, day and time. Processor 12 then retrieves information from memory 14 and drives display driver 16 for displaying a representation of the current state of the tide along with information establishing the time to or from the nearest tidal event, as will be more fully explained below. Display 18 may take the form of any electronic display such as an LCD, a bar graph display, or a CRT display, for example. The display can be microprocessor driven refreshed at 4 KHz, or a hardware driver updated each minute.

Figure 2:
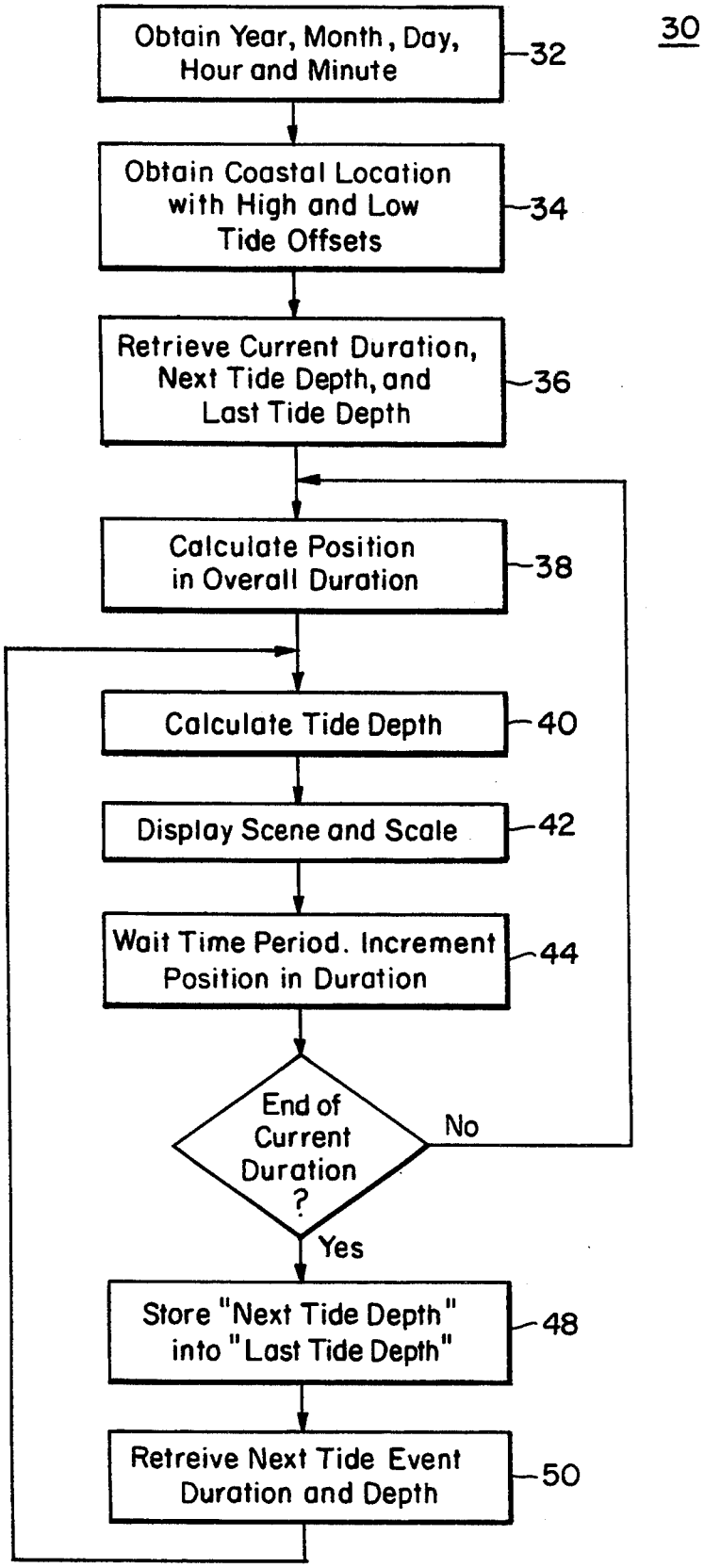
FIG. 2 is a flow chart of an operating system for the tide indicating system of FIG. 1.

Flow chart 30, FIG. 2, depicts the preferred form of operation of the device of FIG. 1 for an embodiment which displays the actual water height. In step 32, the device retrieves the current date and time. This data can be obtained from user input in a known fashion. In step 34, the device acquires the reference coastal location as well as the high and low tide offsets to the location of choice. Typically, the reference location acquisition is accomplished by allowing user selection, for example by providing a menu of coastal locations for which data is stored in memory. The tide offsets are the time differences from reference location to the location of choice. They consist of an hour and minute value for each of the tide events, high and low. The values can be either positive or negative, to compensate for local variations in the time of the tidal extreme. This data can be obtained from user input in a known fashion.

The system, having the current time and the time offsets from a known location, retrieves the duration of the tidal event in process, step 36. The depth information pertaining to the next and previous tides are also retrieved. The retrieval process is as follows:

1. Determine how many minutes into the month the current time is. Referred to as "RTCTime".
2. Retrieve the time of the first high or low tide of the current month for the reference location. Referred to as "TideTime".
3. Retrieve durations between tides and add to the "TideTime" until the value of "TideTime" is greater than "RTCTime". If this process encounters any "Ptides", their durations are summed before adding to the "TideTime". A "Ptide" is an intermediate tide that is used to change the tide depth curve, described below.
4. Add time offset data to "TideTime" for the type (high or low) of tide in progress.
5. Verify that the tide in progress is still after "RTCTime". If not, advance "TideTime" by retrieving the next duration and adding the appropriate time offsets.
6. Verify that "RTCTime" is within the tide in progress by checking the current duration with time offset against the difference between the "TideTime" and the "RTCTime". This would happen if a time offset was added that caused the previous tide to be after the current time. If not correct, subtract the current duration with time offset from "TideTime".
7. Retrieve the Depth Information for both the tide in progress and the previous tide.

Figure 3:
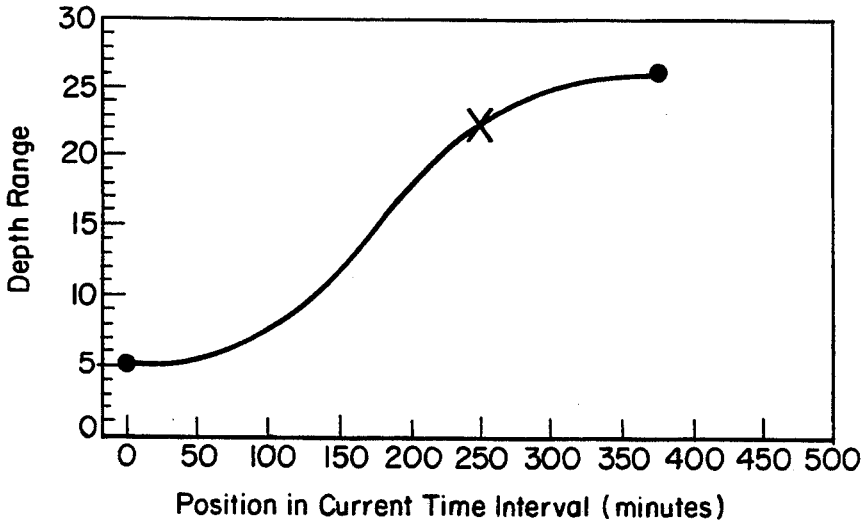
FIG. 3 is a graph of time versus water depth for a typical east coast rising tide, illustrating determination of the water depth by the system of this invention.

In step 38 the temporal position in the current duration is calculated. This is accomplished by subtracting "RTCTime" from "TideTime". The calculation for tide depth, step 40, is done by plotting the "position in the current duration" to a sine curve with the current duration and depth range on the "X" and "Y" axes, respectively, as illustrated in FIG. 3. Any method that results in the following equation is appropriate:

$$\text{Depth} = DR * \sin(((Dur - Rdur)/Dur * 180) - 90) + PDepth.$$

where:

DR = Overall Depth Range for this tide.

Dur = Duration of current tide (minutes).

Rdur = Number of minutes remaining in current duration.

PDepth = Depth of previous tide.

The depth and temporal position data are displayed on the scene and scale, step 42. The scene display utilizes the current depth information. The scale display utilizes the time information. This time information can be displayed in many ways. In the preferred embodiment illustrated herein, the current time, the time of the next tide event, the time remaining until the next tide event, and the type of tide, high vs low, are displayed. It is also possible to display the actual depth, in feet, or future time or depth information.

The system, having displayed the current tide information, continues to cycle through steps 38, 40 and 42 until the current duration is complete. Once the current duration has been completed, the current tide depth information is stored as the last tide depth information, step 48, and the device retrieves tide depth and duration information for the next tide. The operation then proceeds to step 40.

Figure 4:
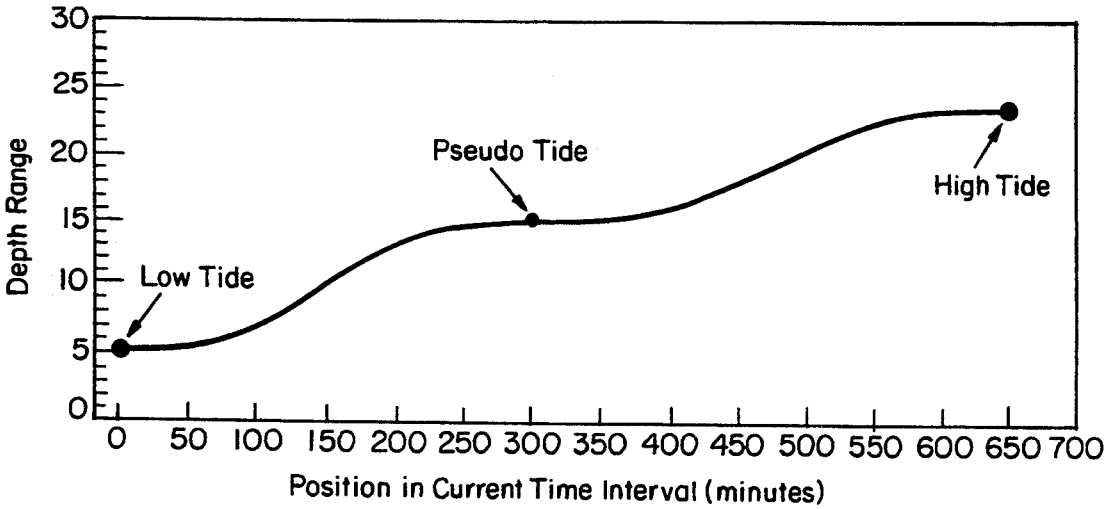
FIG. 4 is a graph similar to that of FIG. 3 for a west coast tide.

FIG. 4 is a graph of time versus depth for a west coast tide, in which the time of a "high" and "low" tide are coincident so that the water stands for a time. The system of this invention calculates depth in such instances by fitting two sine curves to the chart. This is accomplished by establishing a sine curve endpoint labelled "Pseudo Tide" or "PTide". The best point for the PTide is calculated in advance and then stored in system memory. In operation, the system then uses the PTide point as the endpoint of one sine curve starting at the Low Tide point, and as the starting point of a second sine curve ending at the High Tide point.

The PTide location is calculated in advance by placing the point and then calculating depth at hourly intervals using the sine fitting equation above. The calculated data is then compared to NOAA tide chart dam. If there is greater than 6% error at any hour, the PTide location is moved, and the calculations re-run until the best fit is found.

Figure 5:
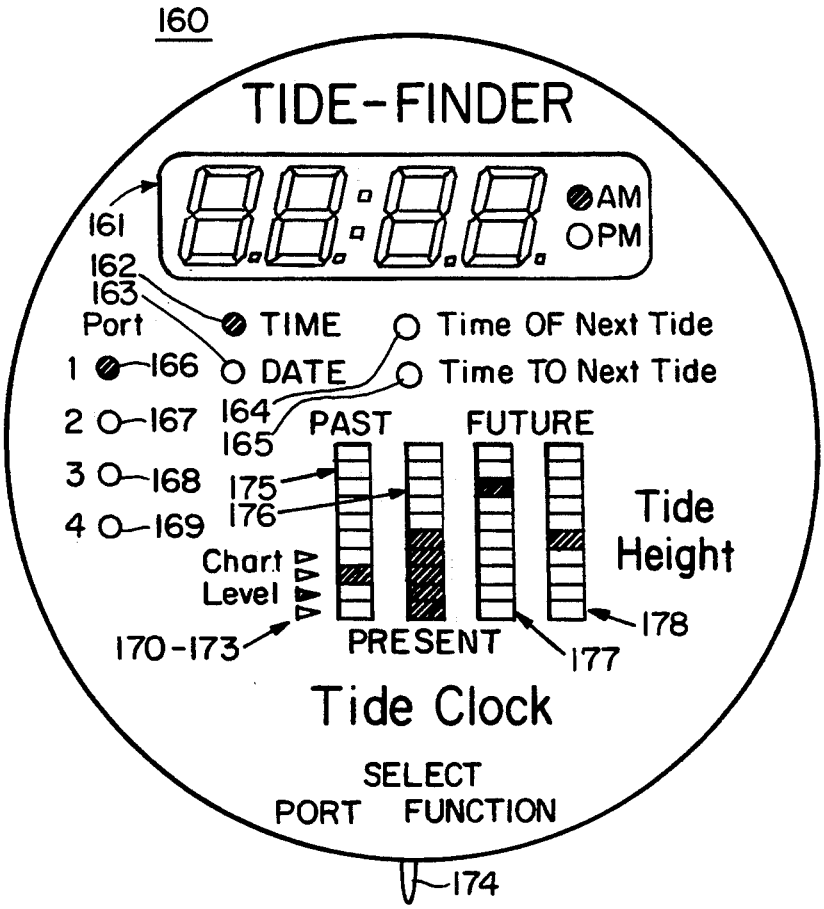
FIG. 5 is a depiction of one form of display for the system of this invention for an embodiment in which actual water depth is determined.

One form of display for system of FIGS. 1 and 2 is shown in FIG. 5, display 160. In this embodiment, the display of water depth is based on the calculated depth.

Display 161 is used for the entry and display of numeric values. For data entry these values include the time, date, coastal location to use as reference and the amount of offset from that reference for the location of choice. For display, these numbers illustrate the time, date, time of the next tide event, the time to the next tide event, and future information. Displays 162–165 indicate which value is being displayed in display 161.

This embodiment allows the user to display information for up to four coastal locations. A select switch is used to specify which location the clock is currently displaying. LED displays 166–169 indicate which user location (numbered 1–4) the entry or display information relates to.

Displays 170–173 indicate which display segment is equal to 0 feet on a standard chart; one of the bottom four segments of displays 175–178.

Switch 174 is for selecting which port to display and for scanning through the display functions. Pushbutton switches may also be used to allow access to future data and for setting the clock.

Displays 175–178 display the calculated water height. Each bar graph has 10 segments. Each segment represents 10% of the maximum range of the tide for a selected location. The first will be lit when the level is between 0–9.99%, the second, between 10–19.99% and so on to the tenth segment which represents 90–100%. Display 175 is used to display the height of the previous tide event. This display uses a single segment to illustrate the level. Display 176 is used to display the present water height at the selected location. This display uses a method of illuminating all segments below the indicating segment to emulate a dip stick. Displays 177 and 178 display the next two tide event heights, similar to display 175.

Figure 6:
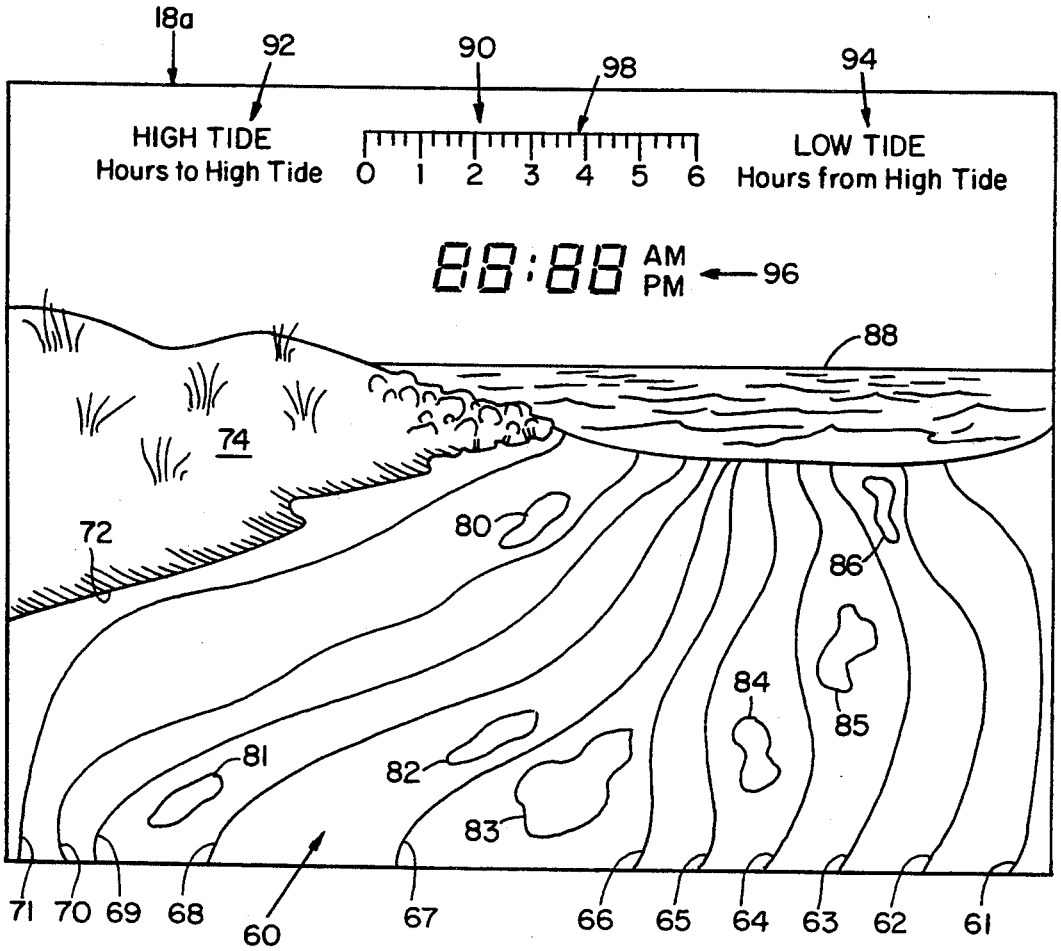
FIG. 6 is a depiction of a second form of display for an embodiment in which relative water depth is displayed based on time alone.

An alternative embodiment is depicted and described in FIGS. 6 and 7. In this embodiment, the display of the water depth is relative, and there is no calculation of the actual water depth. Instead, the device includes a number of graphic scenes between high and low tide, and a number between low and high tide; some may be repeated in a complete tidal cycle. The scenes are sequentially lit to depict relative depth based on predetermined time increments within the current tidal duration.

The duration between two consecutive high tides on the east coast is on the average approximately twelve hours and twenty-five minutes. However, this embodiment of the system is enabled to support actual duration variations from eleven hours and forty-six minutes to twelve hours and forty-five minutes. To account for this variation, a number of time intervals have fixed fifteen minute periods, and one or more intervals have an adjustable period. In the preferred embodiment illustrated herein, in which forty-seven, fifteen-minute intervals of the fifty total intervals are used, several increments are not fixed; two such increments are fifteen minutes long, either of which can be skipped, and the third such interval has a duration of one to thirty minutes, adjustable in one minute intervals, to make up the variation in the tidal duration.

An LCD display that can be used for the system of FIGS. 1 and 2 is shown in FIG. 6. Display **18*a* includes a constant representation of ocean water in area 88 and a varying display in area 60 comprising lines 61 through 71, indicative of the relative height of the tide at a given time. Land mass 74 has shore line 72 establishing the maximum water height. Display 60 also includes displays of puddles 80 through 86 for allowing more variation in the graphical scene depicted. The scale display 90 includes one digital time display and one linear display; scale display 98 of the time to or from high tide event, and digital display 96 of the actual current time. Displays 92 and 94 are lit to display whether the tide is moving to high tide, or from high tide, and when the tide is high or low, in which cases no time indications on display 98 are lit. When the tide is rising, the "hours to high tide" portion of display 92 is lit along with the remaining time indication on display portion 98. When the tide is falling, the "hours from high tide" portion of display 94 is lit, along with the elapsed time indication on display 98. When the tide is high, display 98 is off and the "High Tide" portion of display 92** is lit. At low tide, the display changes from "from high tide" to "to high tide".

Chart 120, FIG. 7, provides portions of display 18a, FIG. 6, that are lit in response to the time interval of the embodiment just described above. The graphical depiction of the relative height of the water is meant to convey information about the actual water height.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. An animated graphic tidal indicator system, comprising:

means for storing time intervals between a plurality of consecutive tides;

means for determining a plurality of temporal positions, each indicative of a relative water depth, in a current time interval based on the actual time of day; and visual display means, responsive to said means for determining, for displaying a plurality of sequential animated scenes representing variations of said relative water depth between tidal extremes in said time interval.

2. The animated graphic tidal indicator system of claim 1 in which said means for determining includes means for dividing the current time interval into a plurality of consecutive time periods.

3. The animated graphic tidal indicator system of claim 2 in which some of said time periods are of predetermined length.

4. The animated graphic tidal indicator system of claim 3 in which the remainder of said time periods are of variable length for accounting for variations in length of said time intervals.

5. The animated graphic tidal indicator system of claim 4 in which one variable length time period is from one to thirty minutes.

6. The animated graphic tidal indicator system of claim 4 further including means, responsive to said means for storing, for setting the lengths of said variable length time periods.

7. The animated graphic tidal indicator system of claim 1 in which there are a plurality of different scenes between high tide and low tide.

8. The animated graphic tidal indicator system of claim 7 in which there are a plurality of different scenes between low tide and high tide.

9. The animated graphic tidal indicator system of claim 8 in which at least one scene is repeated between high tide and low tide and between low tide and high tide.

10. The animated graphic tidal indicator system of claim 1 in which said means for storing includes means for saving time intervals for a plurality of different coastal locations.

11. The animated graphic tidal indicator system of claim 10 further including means for providing a choice between said different coastal locations.

12. The animated graphic tidal indicator system of claim 11 further including means for inserting a tidal time offset for a location not among said plurality of different coastal locations.

13. The animated graphic tidal indicator system of claim 1 further including means for calculating the approximate actual water depth.

14. The animated graphic tidal indicator system of claim 13 in which said means for calculating includes means for retrieving from memory the depth of the previous and next tidal event.

15. The animated graphic tidal indicator system of claim 14 in which said visual display means includes means for displaying the approximate actual water depth.

16. The animated graphic tidal indicator system of claim 15 in which said visual display means includes a bar graph for displaying the approximate actual water depth in relation to lowest and highest water depths.

17. An animated graphic tidal indicator system, comprising:

means for storing time intervals between a plurality of consecutive tidal events, for a plurality of different coastal locations;

means for providing a choice between said different coastal locations, including a default coastal location if no choice is provided;

means for determining the current date and time; and means for displaying a plurality of sequential animated scenes representing the current tidal state for the chosen or default coastal location.

18. The graphic tidal indicator system of claim 17 further including means for inserting a tidal time offset for a location not among said plurality of different coastal locations.

19. An animated graphic tidal indicator system, comprising:

means for storing time intervals between and heights of a plurality of consecutive tides;

means for determining a current temporal position in a current time interval;

means, responsive to said means for determining, and said means for storing, for calculating approximate current water depth; and means for displaying an animated scene depicting said calculated approximate water depth.

20. The graphic tidal indicator system of claim 19 in which said means for displaying includes means for indicating the approximate current water depth in relation to maximum and minimum water depths.

21. The graphic tidal indicator system of claim 20 in which said means for indicating includes a bar graph display.

* * * * *